US006367633B1

(12) United States Patent
Douglas

(10) Patent No.: US 6,367,633 B1
(45) Date of Patent: Apr. 9, 2002

(54) SCREENING DEVICE

(75) Inventor: Paul Douglas, Sheffield (GB)

(73) Assignee: Extec Industries PLC, Sheffield (GB)

( * ) Notice: Subject to any disclaimer, the term of this patent is extended or adjusted under 35 U.S.C. 154(b) by 0 days.

(21) Appl. No.: 09/665,727

(22) Filed: Sep. 20, 2000

(51) Int. Cl.[7] ..... B07B 1/28
(52) U.S. Cl. ..... 209/311; 209/413
(58) Field of Search ..... 209/311, 313, 209/315, 319, 420

(56) References Cited

U.S. PATENT DOCUMENTS

| | | | | |
|---|---|---|---|---|
| 2,058,959 A | | 10/1936 | Denning | |
| 4,082,657 A | | 4/1978 | Gage | |
| 4,855,039 A | * | 8/1989 | Genev | 209/311 |
| 6,000,554 A | * | 12/1999 | Hughes | 209/314 |
| 6,142,308 A | * | 11/2000 | Ghosh et al. | 209/3 |

FOREIGN PATENT DOCUMENTS

| | | | | |
|---|---|---|---|---|
| DE | 763 256 | | 11/1953 | |
| EP | 0 316 461 | | 5/1989 | |
| FR | 2488529 | * | 2/1982 | B07B/1/28 |
| GB | 1082780 | | 9/1967 | |
| WO | WO 97/41971 | | 11/1997 | |

* cited by examiner

*Primary Examiner*—Donald P. Walsh
*Assistant Examiner*—Mark J. Beauchaine
(74) *Attorney, Agent, or Firm*—Workman, Nydegger & Seeley

(57) ABSTRACT

A screening device for screening bulk material and having a screen deck with a loading end and a discharge end, and a frame on which the screen deck is mounted. The screen deck includes a primary screening section and a secondary screening section arranged downstream of the primary section. The primary screen section is adjustable to screen at an angle relative to the secondary screening section.

13 Claims, 1 Drawing Sheet

SCREENING DEVICE

This application claims priority to International Application Number PCT/GB00/00124, filed Jan. 20, 2000 which for purposes of disclosure is incorporated herein by specific reference.

BACKGROUND OF THE INVENTION

1. The Field of the Invention

This invention relates to a screening device for separating-out material in a predetermined size range from a supply of bulk material to the screening device.

2. Relevant Technology

The material to be screened can take many forms, including site clearance material, and crushed stone, and the device has screening apertures which allow material smaller in size than the apertures to pass through while leaving residual material in the device (greater in size than the apertures) to be discharged separately. Depending upon requirements, desired material separated-out from the bulk material supply may comprise the material which has passed through the screening apertures, and/or may comprise the material of greater size than the screening apertures which is discharged separately.

In the screening of crushed stone, or site clearance material (including top soil), it is known to provide so-called "screen decks" which have a generally planar screening surface which is gently inclined to the horizontal so that bulk material can be loaded onto the deck at or near an upper loading end e.g. by discharge from an elevator or from a bucket loader, and then moved along the screening surface towards a lower discharge end while undergoing a screening action in which material smaller in size than the screening apertures is separated-out and is discharged downwardly through the deck to be received by a discharge arrangement e.g. a discharge chute or a discharge conveyor.

The screen deck may be coupled with a vibratory device which applies vibration energy to the deck in order to promote the screening action, and with the deck inclined to the horizontal, gravity action assists the movement of the bulk material over the screening surface. However, in some circumstances, the deck may be arranged substantially horizontally, so that forward movement of the bulk material is derived mainly from the way in which the vibration energy is transmitted to the deck.

Evidently, the actual residence time on the screening deck of any particular part of bulk material being screened will depend upon (a) the nature of the material (b) the slope of the deck and (c) the vibratory energy transmitted to the deck. However, the desired residence time will be a compromise between achieving (1) an acceptable rate of throughput of bulk material and (2) screening efficiency. Thus, a more steeply inclined deck can achieve a faster throughput, but with disadvantage of lowered screening efficiency in that potentially screenable material may be carried over to be discharged with non-screenable material (material greater in size than the screening apertures).

It is therefore known to provide adjustable screen decks (and so-called screen boxes), so that the angle of inclination to the horizontal of the screening surface can be adjusted according to the nature of the material to be screened e.g. dry small aggregate can be handled efficiently with a steeper deck slope than is necessary for wet soil which will require a longer residence time.

After passing through the screening apertures, the screened material may be discharged to a stockpile via a discharge conveyor. Alternatively, the screened material may fall onto a further screening deck with different size screening apertures, if it is required to obtain a further screened size range of material.

The non-screened material which is discharged from a screen deck can be conveyed to any suitable discharge point, or if required can be routed to a further screening device.

Therefore, at present, a screen deck which provides a specific screening function can discharge one portion of screened material downwardly through the screening apertures under gravity action for further handling e.g. discharge to a stockpile or to treatment by a further separate screening device at a different level; and can discharge a second portion of non-screened material from the discharge end of the deck for separate further handling e.g. discharge to a stockpile or treatment by a further and separate screening device also arranged at a different level.

Therefore, existing designs of screening plant usually have a number of screen decks arranged at different levels in order to screen material into different size ranges, and evidently the rate of output of the various screened size ranges of material will be dependent, inter alia, upon the screening area of each deck. If a large throughput of a particular size range is required, then a long deck will be provided, whereas for smaller rates of screening a shorter length of deck may be sufficient. Regardless of the length of the deck, at present entire decks are adjustable when it is desired to adjust the inclination of the deck for the purposes of varying the residence time of any particular material to be screened on the deck.

In the case of a long deck, this may have an adverse effect on screening efficiency since, with the entire screening surface of the deck inclined at the same angle, the speed of movement of the bulk material over the screening surface may vary lengthwise of the deck with consequent variation in effectiveness of the screening action. Thus, at the upper loading end of the deck, the layer of deposited material will be much thicker usually than the material as it moves along the deck towards the discharge end, with consequent variation in speed and screening efficiency. Therefore, with a long deck, the adjustment of the screening deck angle will necessarily have to be a compromise between a desired screening angle at the upper end of the deck (to give a particular desired residence time at the upper end) and the desired screening angle at other regions of the deck.

BRIEF SUMMARY OF THE INVENTION

The present invention seeks to provide a two section screen deck arrangement having improved adjustability of the deck angle compared with existing screen deck designs.

According to the invention there is provided a screening device for screening bulk material and having a screen deck with a loading end for receiving a supply of bulk material and an opposite discharge end for discharging the residue of the bulk material after passage over the screen deck, and a frame on which the screen deck is mounted; in which the screen deck comprises:

- a primary screening section having a loading end to receive the supply of bulk material, and arranged to carry out a preliminary screening action and to discharge the residue of the non-screened material via an opposite discharge end;
- a secondary screening section having a receiving end adjacent to the discharge end of the primary section and arranged to carry out a secondary screening action and to discharge residual non-screened material via an opposite discharge end; and, adjustment means permitting adjustment of the screening angle of one of the sections relative to the other section.

Therefore, by the invention, there is provided a screening deck having at least two sections, and with independent adjustment of the screening angle of one section relative to the other, so as to permit optimum selection of screening angles for each section.

Preferably, the primary and secondary screening sections are mounted on a common sub-frame, which is itself adjustably mounted on a main frame. Therefore, adjustment of the sub-frame can set a general screening angle for the screen deck, and then separate adjustment of the screening angle of said one section can be carried out if required, so that, for any particular screening requirements, the primary and secondary screening sections can have separate screening angles set to provide optimum screening efficiency.

If a longer screening deck is required, more than two sections (the primary and secondary sections) may be provided, and with independent adjustment of the screening angle of at least one of the sections relative to the other section(s).

In a preferred arrangement, the adjustment of the sub-frame will determine the screening angle of the secondary screening section, and the independent adjustment means will permit setting of a required screening angle of the primary section.

The screening device according to the invention may be incorporated in a static screening plant assembly. Alternatively, it may be incorporated in a mobile screening apparatus, preferably self-propelled.

Depending upon the required number of screened size ranges, there will be provision of further screening devices e.g. further screen decks, and preferably separate discharge conveyors will be provided in order to discharge, to separate stockpiles, screened material in different size ranges. The discharge conveyors are preferably foldable, so that they can take-up a suitable transport position, and can be deployed to outwardly extending discharge positions when in operation. The discharge conveyors may include tail conveyors and one or more side conveyors.

If a long multi-deck screen is required, then in a preferred development of the invention primary and secondary screen box sections are provided, which are otherwise similar to the primary and secondary screening sections referred to above.

BRIEF DESCRIPTION OF THE DRAWINGS

A preferred embodiment of screening device according to the invention will now be described in detail, by way of example only, with reference to the accompanying drawing in which.

DETAILED DESCRIPTION OF THE PREFERRED EMBODIMENTS

Figure 1:
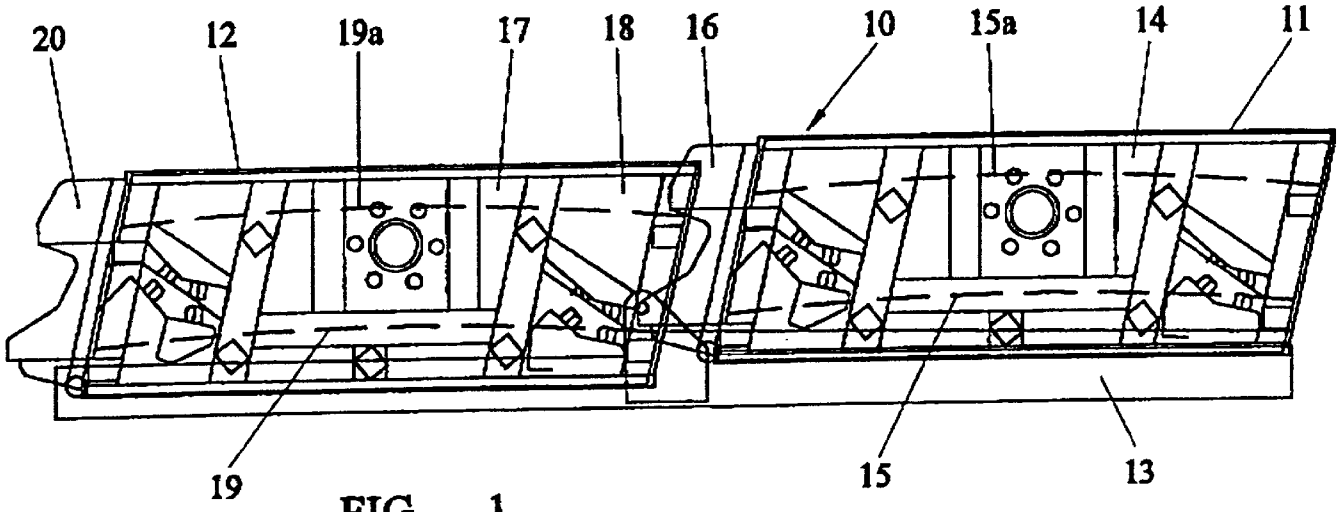
FIG. 1 is a side view of a two section screen deck incorporated in a screening device according to the invention, and occupying one position of relative adjustment of the screening angle; and, FIG. 2 is a view, similar to FIG. 1, showing a further position of relative adjustment of screening angles of the two sections.

Referring now to the drawing, this illustrates, in side view, a two section screen deck to be incorporated in a screening device according to the invention, and which is intended to separate-out material in one or more predetermined size ranges from a supply of bulk material to the screening device. However, if a longer screen deck is required, further section(s) may be provided.

The supply of bulk material to a screen deck can take place by any known means including elevators, and bucket loaders. Similarly, the discharge of one or more screened size ranges can take place via one or more discharge conveyors, and which are capable of being folded between transport positions and deployed outwardly extending positions, and can take the form of e.g. side conveyors and tail conveyors. All of these components are not shown in the drawings, but will be well known to those of ordinary skill in the art, and need not be described in more detail herein.

Figure 2:
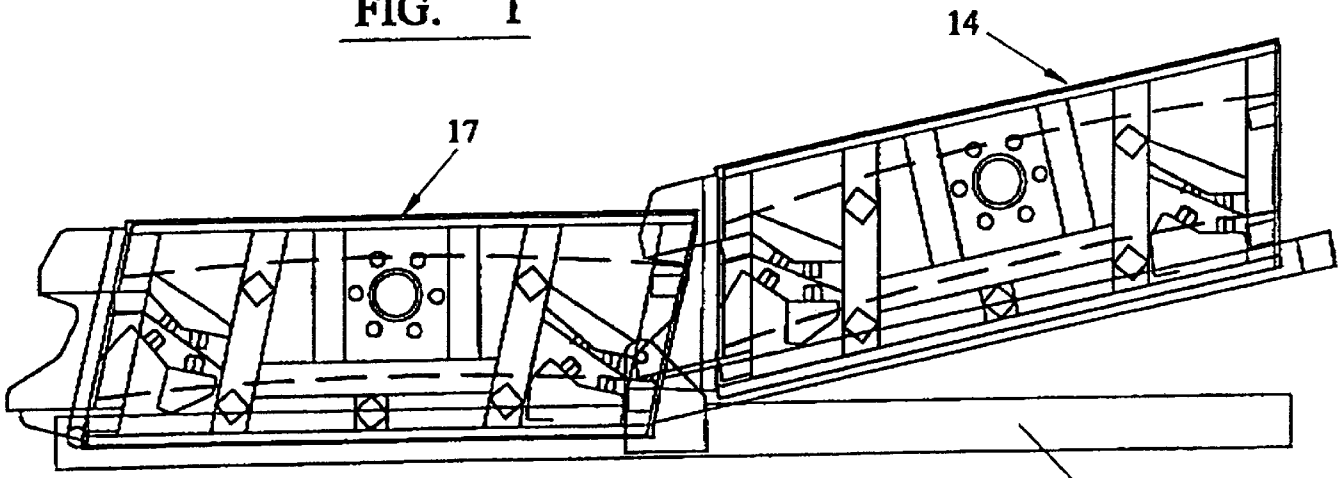

A screening device according to the invention may include further screening components to the two section screen deck which will now be described with reference to FIGS. 1 and 2 of the drawings.

The screen deck is therefore designated generally by reference 10, and has a loading end 11 for receiving a supply of bulk material, and an opposite discharge end 12 for discharging the residue of the bulk material after passage over the screening surface of the screen deck. The screening device has a main frame (not shown), and which may be part of a static screening installation, or may be incorporated into the chassis of a mobile screening plant, preferably a self propelled plant. The screening device also includes a sub-frame, shown schematically by reference 13, on which the screen deck 10 is mounted.

The screen deck 10 comprises a primary screening section 14 which is provided with the loading end 11 which receives the supply of bulk material, and has a screening surface shown by dashed outline 15, on which a preliminary screening action is applied to the bulk material, and then the residue of non-screened material is discharged via opposite discharge end 16 of the primary screening section 14. The primary section 14 may comprise a single screen deck section 15, or may be a multi-deck or "screen box" type of arrangement, having a further screening surface 15*a* located above screening surface 15.

A secondary screening section 17 has a receiving end 18 arranged adjacent to the discharge end 16 of the primary section 14, and having a screening surface 19 (and preferably an overlying further screening surface 19*a* if a multi-deck section arrangement is required to provide a secondary screen box), and which carries out a secondary screening action on the residue received from the primary section 14, and then discharges the residual non-screened material via an opposite discharge end 20.

The primary screening section 14 and secondary screening section 17 are both mounted on sub-frame 13, and the sub-frame can be adjusted relative to the main frame in order to set a general screening angle for the screen deck formed by the assembly of primary and secondary screening sections 14 and 17. In the embodiment illustrated, this actually sets the screening angle for the secondary screening section 17, and adjustment means (not shown in detail) is provided to permit adjustment of the screening angle of the primary section 14 relative to the secondary section 17. FIG. 1 shows a substantially co-planar adjustment of the primary and secondary screening sections, whereas FIG. 2 shows an upwardly inclined adjustment of the primary section 14, giving a steeper screening angle, and therefore a greater effect of gravity action of the bulk material while it undergoes screening action. The shallower screening angle of the secondary section 17, shown in FIG. 2, will provide a longer residence time during which the residue of material received from the primary section 14 undergoes the secondary screening action.

It should be understood that the illustrated embodiment, showing independent adjustment of the screening angle of the primary section 14, is by way of example only, and that the invention contemplates independent adjustment of the secondary screening section 17, although this is not shown.

The invention also further contemplates the provision of independent adjustment of the screening angle of both of the sections 14 and 17.

Any suitable power or manually operated adjustment mechanisms may be provided in order to permit required adjustment of the screening angles of the screening sections of the screen deck.

As mentioned above, an effective single long screen deck can be provided by the two separate screening sections 14 and 17, but as shown the invention also contemplates the provision of an effective single long screen box assembly by provision of primary and secondary screen box sections, of which at least one is independently adjustable in its screening angle relative to the other.

To promote the screening action, one, and preferably both of the sections 14, 17 incorporate vibratory devices 21 to apply vibrational energy to the screen decks.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes 19 which come within the meaning and range of equivalency of the claims are to be embraced within their scope.

What is claimed and desired to be secured by United States Letters Patent is:

1. A screening device for screening bulk material and comprising:

a main frame;

a sub-frame adjustably mounted on the main frame;

a screen deck mounted on the sub-frame such that the adjustment of the sub-frame relative to the main frame sets a general screening angle for the screen deck, and said screen deck comprising:

(i) a primary screening section arranged to carry out a preliminary screening action and having a loading end to receive a supply of bulk material and an opposite discharge end to discharge a residue of non-screened material;

(ii) a secondary screening section having a receiving end adjacent to the discharge end of the primary section and arranged to carry out a secondary screening action, and having an opposite discharge end to discharge residual non-screened material, one of the primary screening section and secondary screening section being selectively adjustable to operate at an angle relative to the other and at an angle relative to the screen deck.

2. A screening device according to claim 1, wherein the screen deck comprises more than two screening sections, and with independent adjustment of the screening angle of at least one of the sections being possible relative to the other section(s).

3. A screening device according to claim 1, in which the adjustment of the sub-frame relative to the main frame determines the screening angle of the secondary screening section, and wherein the primary screening section is selectively adjustable to operate at an angle relative to the second screening section.

4. A screening device according to claim 1, and incorporated in a static screening plant assembly.

5. A screening device according to claim 1, and incorporated in a mobile screening apparatus.

6. A screening device according to claim 5, in which the mobile screening apparatus is self-propelled.

7. A screening plant assembly incorporating a plurality of screening devices according to claim 1, and including separate discharge conveyors arranged to discharge, to separate stockpiles, screened material in different size ranges.

8. A screening plant assembly according to claim 7, in which the discharge conveyors are foldable, so that they can take up a suitable transport position, and can be deployed to outwardly extending discharge positions when in operation.

9. A screening plant including more than one screening device according to claim 1, in which each of the primary and secondary screening sections includes a multi-deck screen.

10. A screening device for screening bulk material and comprising:

a sub-frame adjustably mounted for selective disposition at an angle relative to a horizontal plane;

a screen deck mounted on the sub-frame such that the adjustment of the sub-frame relative to the horizontal plane sets a general screening angle for the screen deck, the screen deck comprising:

(i) a primary screening section arranged to carry out a preliminary screening action and having a loading end to receive a supply of bulk material and an opposite discharge end to discharge a residue of non-screened material;

(ii) a secondary screening section having a receiving end adjacent to the discharge end of the primary screening section and arranged to carry out a secondary screening action, and having an opposite discharge end to discharge residual non-screened material, one of the primary screening section and secondary screening section being selectively adjustable to operate at an angle relative to the other and at an angle relative to the screen deck.

11. A screening device as recited in claim 10, wherein the primary screening section is selectively adjustable relative to the secondary screening section such that primary screening section can be disposed at an angle relative to the secondary screening section.

12. A screening device as recited in claim 10, wherein both the primary screening section and the secondary screening section are adjustable relative to the sub-frame so as to each operate at an angle relative to the sub-frame.

13. A screening device as recited in claim 10, wherein at least one of the primary and secondary screening sections includes a multi-deck screen.

* * * * *